US008517472B1

(12) United States Patent
Proctor

(10) Patent No.: US 8,517,472 B1
(45) Date of Patent: Aug. 27, 2013

(54) ADJUSTABLE FOOT-REST CHAIR RING

(75) Inventor: Gerald Lynn Proctor, Bryan, TX (US)

(73) Assignee: Ergo Genesis, LLC, Navasota, TX (US)

( * ) Notice: Subject to any disclaimer, the term of this patent is extended or adjusted under 35 U.S.C. 154(b) by 0 days.

(21) Appl. No.: 13/096,759

(22) Filed: Apr. 28, 2011

(51) Int. Cl.
*A47C 7/50* (2006.01)

(52) U.S. Cl.
USPC ..... 297/423.1; 297/423.38

(58) Field of Classification Search
USPC ..... 297/423.18, 344.12, 423.1, 423.39, 297/423.38; 248/188.7, 188.8; D6/500, D6/375, 360
See application file for complete search history.

(56) References Cited

U.S. PATENT DOCUMENTS

| | | | | | |
|---|---|---|---|---|---|
| D123,259 | S | | 10/1940 | Cramer | |
| 3,086,741 | A | * | 4/1963 | Cramer, Jr. | 248/188.7 |
| 3,376,068 | A | | 4/1968 | Walkinshaw | |
| 3,415,475 | A | * | 12/1968 | Goodman | 248/158 |
| 3,458,234 | A | * | 7/1969 | Bates | 297/423.38 |
| 4,623,195 | A | | 11/1986 | Avella | |
| D296,130 | S | | 6/1988 | Riske | |
| D371,923 | S | | 7/1996 | Chen | |
| D401,088 | S | | 11/1998 | Chen | |
| 5,836,555 | A | | 11/1998 | Ellsworth et al. | |
| 5,988,754 | A | * | 11/1999 | Lamart et al. | 297/423.38 |
| 6,142,571 | A | * | 11/2000 | Benden | 297/423.4 |
| 6,149,239 | A | * | 11/2000 | Markussen et al. | 297/423.4 |
| D437,770 | S | * | 2/2001 | Garske et al. | D8/349 |
| D475,995 | S | * | 6/2003 | Hsieh | D14/229 |
| 6,695,407 | B1 | | 2/2004 | Lin | |
| 7,036,886 | B2 | | 5/2006 | Benden et al. | |
| D552,898 | S | | 10/2007 | Wei | |
| 7,452,034 | B2 | * | 11/2008 | Jung | 297/423.1 |
| 7,530,639 | B2 | | 5/2009 | Groelsma et al. | |
| D634,737 | S | * | 3/2011 | Lippert et al. | D14/229 |
| 2003/0151291 | A1 | | 8/2003 | Lin et al. | |
| 2007/0158993 | A1 | | 7/2007 | Groelsma et al. | |
| 2007/0290541 | A1 | * | 12/2007 | Tsai | 297/423.1 |
| 2008/0185896 | A1 | * | 8/2008 | Wei | 297/423.19 |

* cited by examiner

*Primary Examiner* — David Dunn
*Assistant Examiner* — Richard Lowry
(74) *Attorney, Agent, or Firm* — Eric W. Cernyar

(57) ABSTRACT

An ergonomic, rotatable foot-rest chair ring for an adjustable-height chair is provided. The chair ring comprises a rotation hub configured to be rotatably mounted on the seat post of an adjustable height chair and angularly displaced spokes extending radially from the rotation hub to a modified foot-supporting ring. The modified ring has a perimeter defined by a convex-ring-shaped section that extends more than half way around the hub and a recessed, concave arc section that completes the perimeter.

18 Claims, 5 Drawing Sheets

ADJUSTABLE FOOT-REST CHAIR RING

FIELD OF THE INVENTION

This invention relates generally to adjustable-height chairs, and more particularly to foot rings for chairs.

BACKGROUND OF THE INVENTION

A conventional adjustable-height chair comprises a height-adjustable seat mounted to a post mounted to a base. Seats operable to be elevated a considerable height, for example, to the height of a conventional stool, frequently come with foot rests. Typically, however, the foot rests are circular and mounted in a fixed position with respect to the seat post. When the seat is lowered to a low height, for example, a desk-chair configuration, the foot rest obstructs a user from tucking his or her legs under the seat.

U.S. Pat. No. 5,836,555 to Ellsworth et al. discloses an industrial chair with radially extending legs to which are attached a plurality of vertically-stepped foot rests. Ellsworth et al. explains that once in a seated position, the user may select which of the footrests, which are configured at different heights, with which to support his/her legs. The footrests, however, are not designed to swivel around the seat post. U.S. Pat. No. 7,452,034 to Jung discloses a sector-shaped foot rest for a chair, but it also is not designed to swivel around the seat post. With these and similar designs, a user who adjusts the seat from a height for which a foot rest is desirable to one in which the foot rest is out of the way is faced with the cumbersome task of getting out of the chair to turn the chair base around or remove the foot rest from the chair.

SUMMARY OF THE INVENTION

An ergonomic, rotatable foot-rest chair ring for an adjustable-height chair is provided. The chair ring comprises a rotation hub configured to be rotatably mounted on the seat post of an adjustable height chair and angularly displaced spokes extending radially from the rotation hub to a modified foot-supporting ring. The modified ring has a perimeter defined by a convex-ring-shaped section that extends more than half way around the hub and a recessed, concave arc section that completes the perimeter. When the chair is positioned in a seat-elevated stool configuration, the chair ring is rotated to position the convex, ring-shaped section toward the front of the chair, in order to support the feet of a person sitting in the chair. When the chair is positioned in a seat-lowered desk configuration, the chair ring is rotated to position the recessed, concave arc section toward the front of the chair, in order to avoid obstruction of the legs of a person sitting in the chair.

In a more particular embodiment, the chair ring has five angularly displaced spokes, one of which is joined to the midpoint of the recessed, concave arc section. The other four spokes are joined, in a bilaterally symmetric way, to the convex, ring-shaped section, which extends approximately 240 degrees around the rotation hub. Each of the spokes has an isosceles-trapezoid-shaped cross section and gradually widens, like a widening light beam, from a narrow extent near the rotation hub to a wide extent near the modified ring.

The rotation hub itself is pentaradially symmetric, having a substantially pentagonal shape with concavely curved outer sidewalls. The outer sidewalls of the rotation hub also flare outwardly from top to bottom. The rotation hub comprises an inner collar with an interiorly-threaded top section and a conically tapered bottom section. The inner collar is joined by a plurality of ribs to an intermediately-positioned collar, which is, in turn, joined by those ribs to the curved and flared outer sidewalls.

To minimize weight, the chair ring has a substantially continuous top surface, substantially continuous side surfaces, and an open bottom. A plurality of intersecting, diagonally-oriented ribs extend between the sidewall structures of the chair ring, giving the chair ring considerable strength.

DETAILED DESCRIPTION

Figure 1:
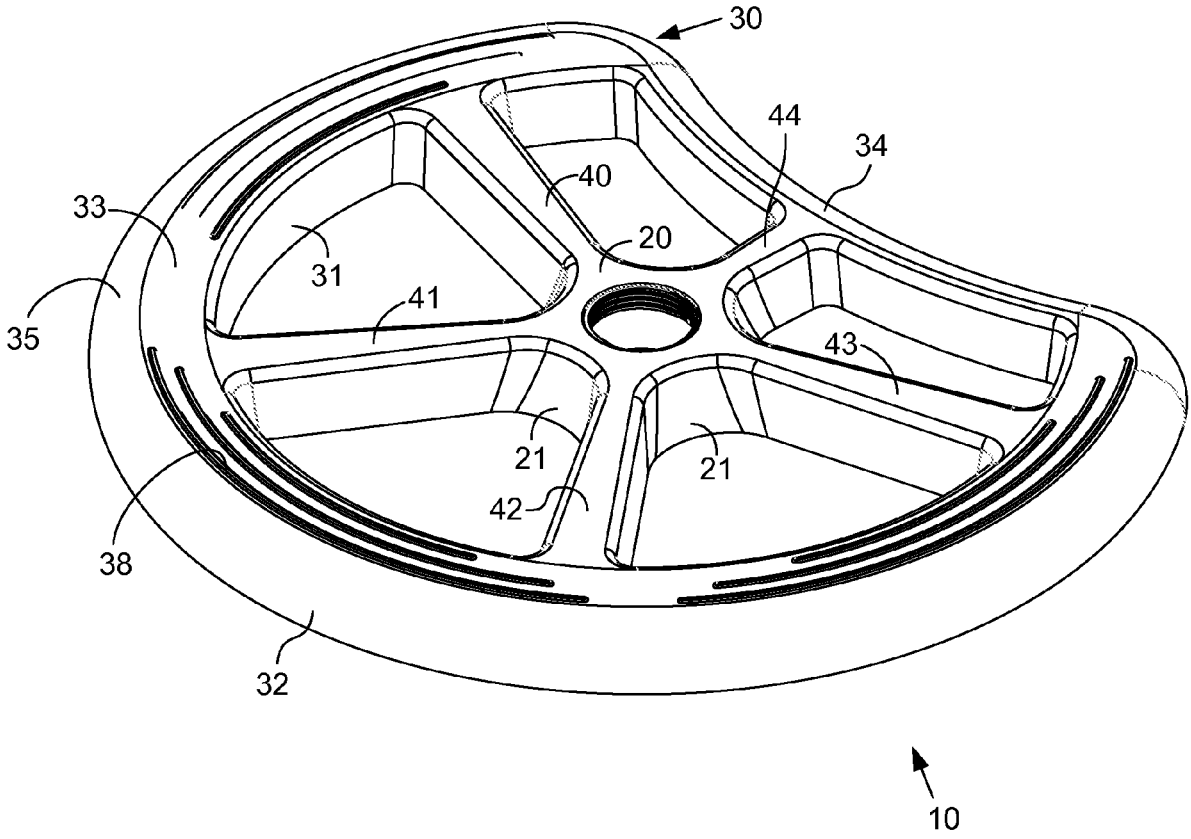
FIG. 1 is a perspective view of one embodiment of a foot-rest chair ring.
Figure 2:
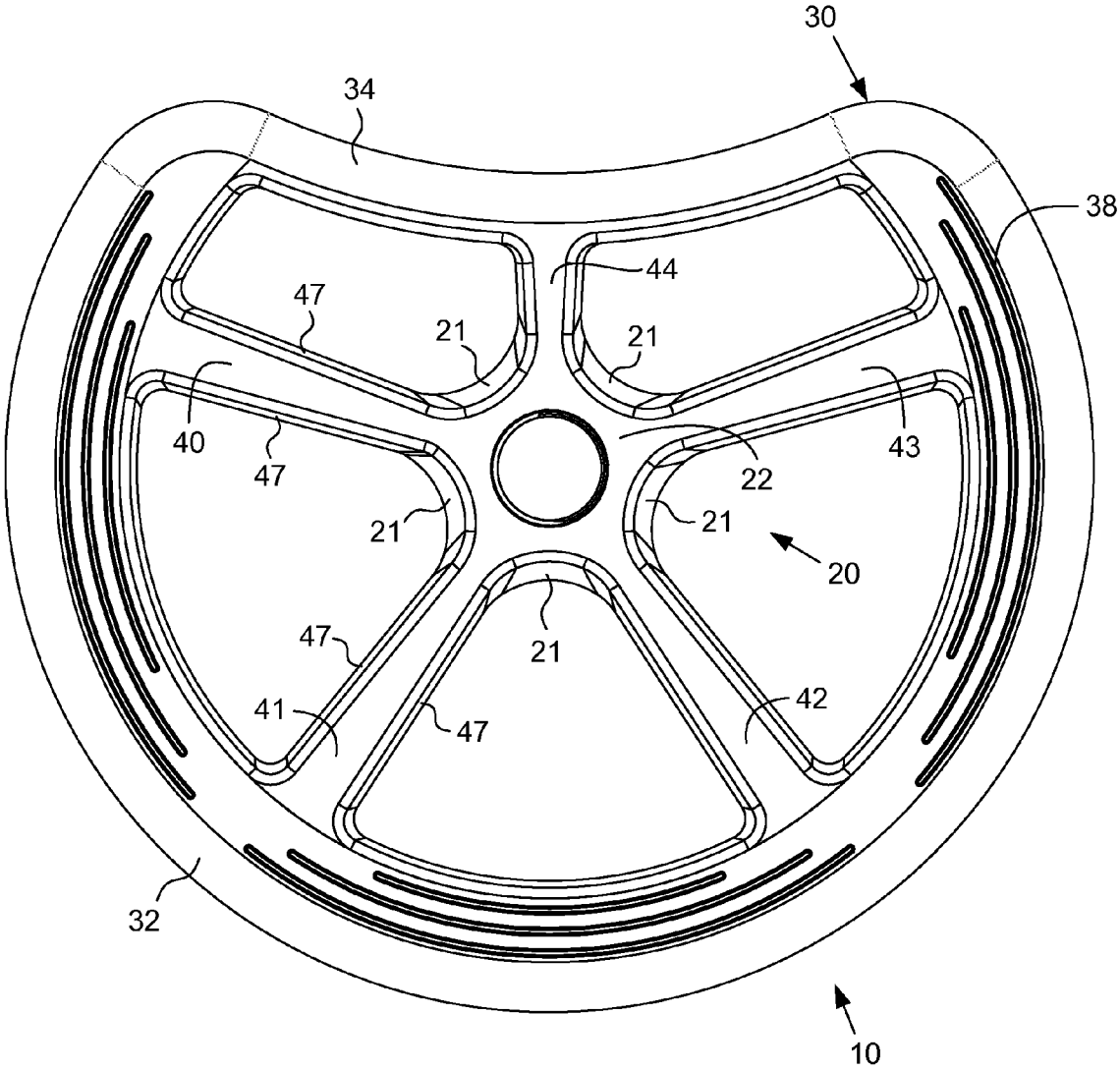
FIG. 2 is a top view the foot-rest chair ring of FIG. 1
Figure 3:
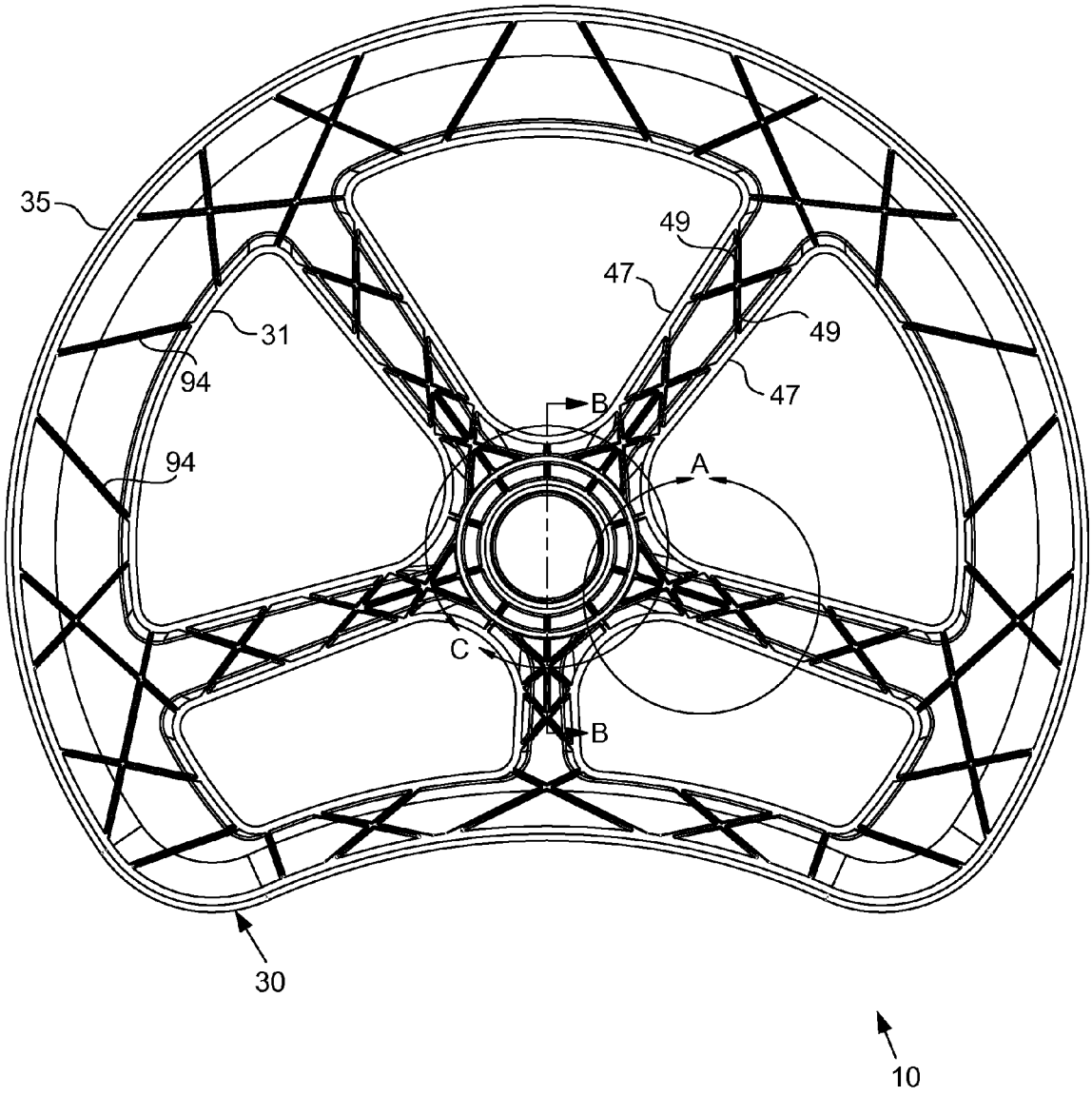
FIG. 3 is a bottom view of the foot-rest chair ring of FIG. 1.

In describing preferred and alternate embodiments of the technology described herein, as illustrated in FIGS. 1-6, specific terminology is employed for the sake of clarity. The technology described herein, however, is not intended to be limited to the specific terminology so selected, and it is to be understood that each specific element includes all structural equivalents that operate in a similar manner to accomplish similar functions.

FIGS. 1-6 illustrate one embodiment of a foot-rest chair ring 10 for an adjustable-height chair (not shown) with a seat operable to be raised and lowered between an elevated stool configuration and a relatively lower desk configuration. The illustrated foot-rest chair ring 10 is suitable for a wide variety of adjustable chairs with a center support seat post or pedestal.

The foot-rest chair ring comprises a rotation hub 20 configured to be rotatably mounted onto a seat post of an adjustable-height chair, a modified ring 30 surrounding the rotation hub 20, and five angularly displaced spokes 40-44 extending radially from the rotation hub 20 to the modified ring 30.

The modified ring 30 has a perimeter defined by a convex, ring shaped section 32 and a recessed, concave arc section 34. The convex, ring-shaped section 32 extends more than 180 degrees (more particularly, in one embodiment, about 240 degrees) around the rotation hub 20. The convex, ring-shaped section 32 is configured to support the feet of a person sitting in the chair when the chair is in the stool configuration. The convex, ring-shaped section 32 of the modified ring has a substantially cylinder-conforming inner sidewall 31, a substantially planar top surface 33 with a non-slip molded top surface texture 38, and a rounded outer sidewall 35. The recessed, concave arc section 34 completes the perimeter and is configured to avoid obstruction of the legs of a person sitting in the chair when the chair is in the desk configuration. As the concave arc section 34 is not used to support the feet, it has a narrower width than the convex, ring-shaped section 32. The concave arc section 34 also has a radius that is substantially greater than the radius of the convex, ring-shaped section 32.

Each of the spokes 40-44 extends radially from the rotation hub 20 to the modified ring 30. Each of the spokes 40-44 is distributed 72 degrees apart, relative to each other. Each of the spokes 40-44 has a cross section shaped substantially like an isosceles trapezoid (with rounded top corners), which widens from a narrow extent near the rotation hub 20 to a wide extent near the modified ring 30. One of the spokes, spoke 44, is shorter than the other spokes 40-43, and joins the recessed, concave arc section 34 of the modified ring 30 at the midpoint of the recessed, concave arc section 34. The other four spokes 40-43 are of equal length.

Figure 4:
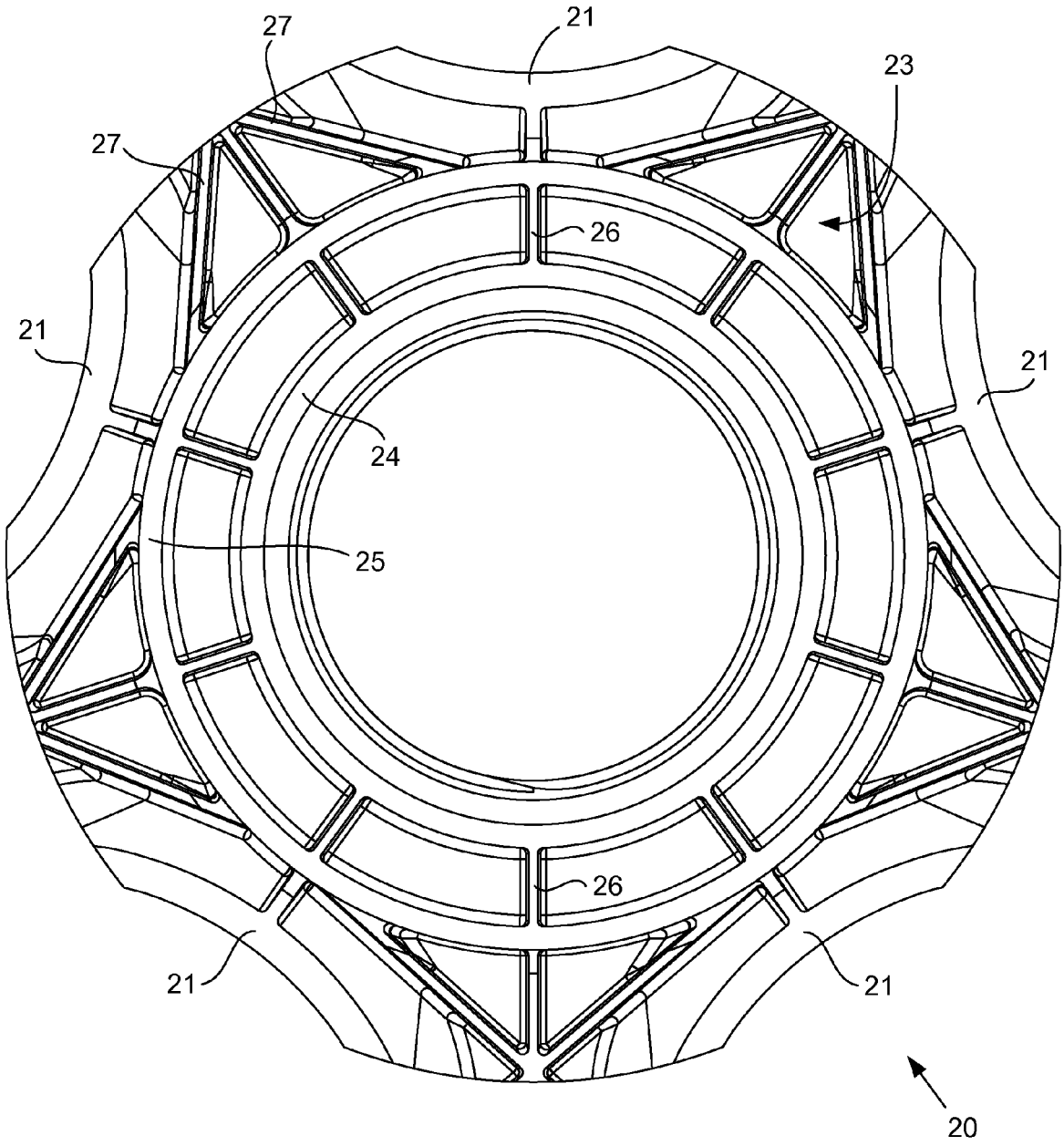
FIG. 4 is an enlarged view of the section designated "A" in FIG. 3.
Figure 5:
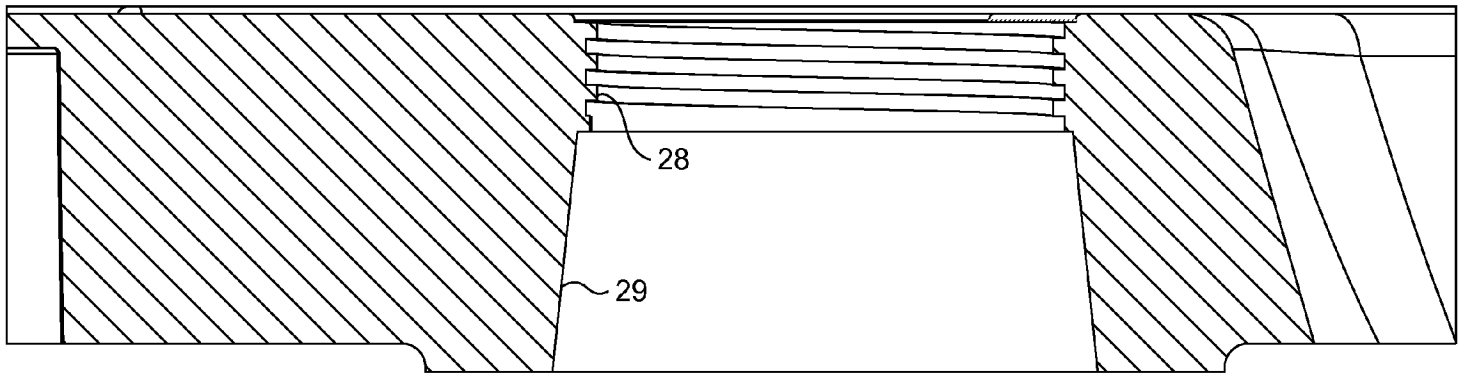
FIG. 5 is a partial cross-sectional view taken along line B-B of FIG. 3.
Figure 6:
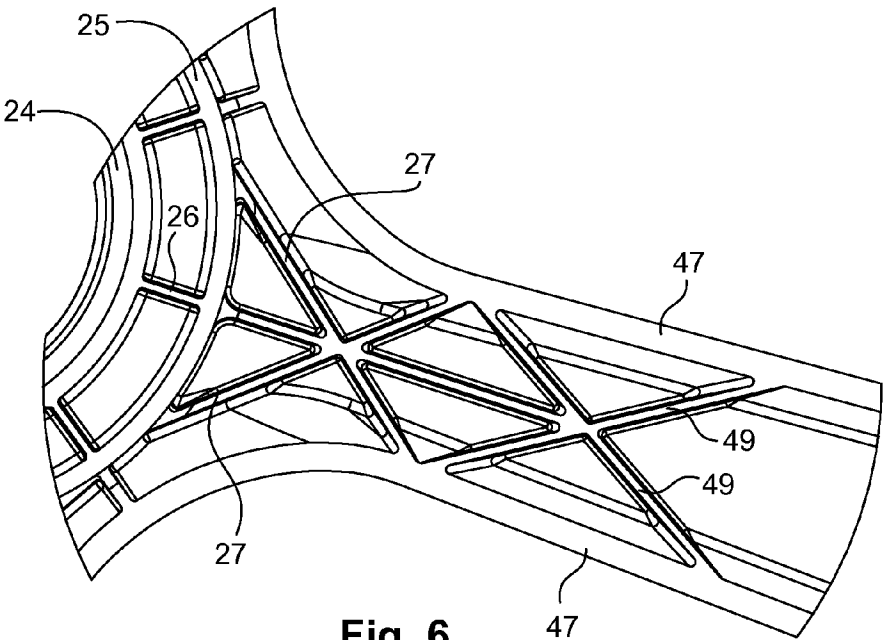
FIG. 6 is an enlarged view of the section designated "C" in FIG. 3.

The rotation hub 20 is pentaradially symmetric, having a substantially pentagonal shape with concavely curved outer sidewalls 21. The rotation hub 20 also has a closed, planar top side 22 and an open bottom 23 (FIG. 4). As shown most clearly in FIGS. 1 and 2, the outer sidewalls 21 flare outwardly from top to bottom, giving the top side 22 of the rotation hub 20 a somewhat nested appearance, relative to the perimeter defined by the hub's bottom 23. As seen best in FIG. 4, the rotation hub 20 structurally comprises an inner collar 24 joined by radially-aligned ribs 26 to an intermediately-positioned collar 25 and the outer sidewalls 21 of the rotation hub 20. As best seen in FIG. 6, a plurality of diagonally-oriented ribs 27 couple the intermediately-positioned collar 25 to the trapezoidally-tapered sidewalls 47 of the spokes 40-44. Turning to FIG. 5, the inner collar 24 is defined by an interiorly threaded cylindrical top section 28 and a conically-tapered bottom section 29. The threads enable the chair ring 10 to swivel about the seat post of an adjustable-height chair. Other mechanisms for coupling the chair ring 10 to the seat post, including configurations that enable vertical adjustment of the chair ring 10 with respect to the seat post, are also contemplated and within the scope of the invention.

Like the rotation hub 20, the modified ring 30 and spokes 40-44 have an open bottom. A plurality of intersecting, diagonally-oriented ribs 94 extend between the inner sidewall 31 and rounded outer sidewall 35 of the modified ring 20. Likewise, a plurality of intersecting, diagonally-oriented ribs 49 extend between opposite sidewalls 47 of the spokes. This structural pattern facilitates a light-weight yet strong design for the chair ring 10.

Although no complete chair is illustrated in the drawings, the present invention also extends to the combination of an adjustable-height chair with a foot-rest chair ring designed in accordance with the present invention.

The foregoing specific details describe various embodiments of the invention, but persons reasonably skilled in the art will recognize that various changes may be made in the details of the apparatus or method of this invention without departing from the spirit and scope of the invention as defined in the appended claims. The present invention includes several independently meritorious inventive aspects and advantages. Unless compelled by the claim language itself, the claims should not be construed to be limited to structures that incorporate all of the inventive aspects, or enjoy all of the advantages, disclosed herein.

I claim:

1. A foot-rest chair ring for an adjustable-height chair with a seat operable to raised and lowered between a stool configuration and a desk configuration, the foot-rest chair ring comprising:

a rotation hub configured to be rotatably mounted onto a seat post of the adjustable-height chair;

a modified ring surrounding the rotation hub; and angularly displaced spokes extending radially from the rotation hub to the modified ring;

wherein the modified ring has a perimeter defined by:

(a) a convex, ring-shaped section that extends more than 180 degrees around the hub and is configured to support the feet of a person sitting in the chair when the chair is in the stool configuration; and (b) a recessed, concave arc section that completes the perimeter and is configured to avoid obstruction of the legs of a person sitting in the chair when the chair is in the desk configuration; and wherein one of the spokes joins the recessed, concave arc section of the modified ring at a midpoint of the recessed, concave arc section.

2. The foot-rest chair ring of claim 1, wherein five angularly displaced spokes extend radially from the rotation hub to the modified ring.

3. The foot-rest chair ring of claim 2, wherein the rotation hub is pentaradially symmetric.

4. The foot-rest chair ring of claim 3, wherein the rotation hub has a substantially pentagonal shape.

5. The foot-rest chair ring of claim 4, wherein the outer sidewalls of the rotation hub flare outwardly from top to bottom.

6. The foot-rest chair ring of claim 2, wherein each of the spokes widens from a narrow extent near the rotation hub to a wide extent near the modified ring.

7. The foot-rest chair ring of claim 6, wherein each of the spokes has a cross-section shaped substantially like an isosceles trapezoid.

8. The foot-rest chair ring of claim 2, wherein the convex, ring-shaped section of the modified ring extends approximately 240 degrees around the hub.

9. The foot-rest chair ring of claim 8, wherein the convex, ring-shaped section of the modified ring has a substantially cylinder-conforming inner sidewall, a substantially planar top surface, and a rounded outer sidewall.

10. An adjustable-height chair comprising:

a seat post;

a seat mounted on the seat post and operable to be raised and lowered between a stool configuration and a desk configuration;

a foot-rest chair ring comprising:

a rotation hub rotatably mounted onto the seat post of the adjustable-height chair;

a modified ring surrounding the rotation hub; and angularly displaced spokes extending radially from the rotation hub to the modified ring;

wherein the modified ring has a perimeter defined by:

(a) a convex, ring-shaped section that extends more than 180 degrees around the hub and is configured to support the feet of a person sitting in the chair when the chair is in the stool configuration; and (b) a recessed, concave arc section that completes the perimeter and is configured to avoid obstruction of the legs of a person sitting in the chair when the chair is in the desk configuration; and wherein one of the spokes joins the recessed, concave arc section of the modified ring at a midpoint of the recessed, concave arc section.

11. The adjustable-height chair of claim 10, wherein five angularly displaced spokes extend radially from the rotation hub to the modified ring.

12. The adjustable-height chair of claim 11, wherein the rotation hub is pentaradially symmetric.

13. The adjustable-height chair of claim 12, wherein the rotation hub has a substantially pentagonal shape.

14. The adjustable-height chair of claim 13, wherein the outer sidewalls of the rotation hub flare outwardly from top to bottom.

15. The adjustable-height chair of claim 11, wherein each of the spokes widens from a narrow extent near the rotation hub to a wide extent near the modified ring.

16. The adjustable-height chair of claim 15, wherein each of the spokes has a cross-section shaped substantially like an isosceles trapezoid.

17. The adjustable-height chair of claim 11, wherein the convex, ring-shaped section of the modified ring extends approximately 240 degrees around the hub.

18. The adjustable-height chair of claim 17, wherein the convex, ring-shaped section of the modified ring has a substantially cylinder-conforming inner sidewall, a substantially planar top surface, and a rounded outer sidewall.

* * * * *